US012460332B2

(12) United States Patent
Ishihara

(10) Patent No.: US 12,460,332 B2
(45) Date of Patent: Nov. 4, 2025

(54) OPERATION INFORMATION OBTAINING DEVICE AND OPERATION INFORMATION OBTAINING METHOD

(71) Applicant: JUKI CORPORATION, Tokyo (JP)

(72) Inventor: Kazuyuki Ishihara, Tokyo (JP)

(73) Assignee: Juki Corporation, Tokyo (JP)

( * ) Notice: Subject to any disclaimer, the term of this patent is extended or adjusted under 35 U.S.C. 154(b) by 0 days.

(21) Appl. No.: 18/522,125

(22) Filed: Nov. 28, 2023

(65) Prior Publication Data

US 2024/0175176 A1 May 30, 2024

(30) Foreign Application Priority Data

Nov. 29, 2022 (JP) ..... 2022-190604

(51) Int. Cl.
*D05B 19/08* (2006.01)

(52) U.S. Cl.
CPC ..... *D05B 19/08* (2013.01)

(58) Field of Classification Search
CPC ..... D05B 19/08; D05B 55/14; D05B 55/08
See application file for complete search history.

(56) References Cited

U.S. PATENT DOCUMENTS 4,612,867 A 9/1986 Roesch et al.
6,123,040 A * 9/2000 Hayakawa ..... D05B 19/085 112/458
2020/0048807 A1* 2/2020 Imaizumi ..... D05B 79/00
2021/0310167 A1* 10/2021 Minematsu ..... D05B 19/12
2022/0064834 A1* 3/2022 Minematsu ..... D05C 9/04
2023/0018427 A1* 1/2023 Shibata ..... D05B 19/10

FOREIGN PATENT DOCUMENTS

CN 109554833 A 4/2019
EP 3885481 A1 9/2021
WO WO-0060156 A1 * 10/2000 ..... D05B 19/12

OTHER PUBLICATIONS

Extended European Search Report from European Patent Application No. 23212541.9, dated Apr. 8, 2024, 7 pages.

* cited by examiner

*Primary Examiner* — Tajash D Patel
(74) *Attorney, Agent, or Firm* — BAKERHOSTETLER

(57) ABSTRACT

The present application effectively utilizes the operation information of a sewing machine. The operation information obtaining device includes: a storage portion, configured to store pattern information associating detection information and a sewing pattern of a sewing machine, where the detection information is configured to identify an action of a sewing needle of the sewing machine, and the sewing pattern corresponds to the detection information; an estimation portion, configured to estimate the sewing pattern of the sewing machine based on the pattern information and the detection information of the sewing needle detected by a detection device; and an obtaining portion, configured to obtain operation information of the sewing machine having the estimated sewing pattern.

6 Claims, 8 Drawing Sheets

| Sewing point | Action of the sewing machine |
|---|---|
| P1 | Start of pattern sewing |
| P1→P2 | Sewing + thread trimming |
| P2→P3 | Idle feeding |
| P3→P4 | Sewing + thread trimming |
| P4→P5 | Idle feeding |
| P5→P6 | Sewing + thread trimming |
| P6→P7 | Idle feeding |
| P7→P8 | Sewing + thread trimming |
| P8 | End of pattern sewing |

500

| Sewing pattern | Measurement information |
|---|---|
| PID-1 | Measurement information 124-1 |
| PID-2 | Measurement information 124-2 |
| PID-3 | Measurement information 124-3 |
| ⋮ | ⋮ |

OPERATION INFORMATION OBTAINING DEVICE AND OPERATION INFORMATION OBTAINING METHOD

FIELD

The present application relates to an operation information obtaining device and an operation information obtaining method.

BACKGROUND

In sewing plants, etc., it is required to manage operation information of the sewing machines being used. For example, a technique for obtaining operation information regardless of types of sewing machines is disclosed in Japanese Patent Application Publication No. JP2021153947A.

SUMMARY

(1) Technical Problems to be Solved

In traditionally method for obtaining the operation information, even if it was possible to detect the start or stop of the rotation of a sewing machine and thread trimming etc., it was not possible to detect information related to other operations. Therefore, in the related art, there is a room for improvement in effectively utilizing the obtained operation information of the sewing machine.

The present application is intended to effectively utilize the operation information of the sewing machine.

(2) Technical Solutions

According to the present application, an operation information obtaining device includes: a storage portion, configured to store pattern information associating detection information and a sewing pattern of a sewing machine, the detection information is configured to identify an action of a sewing needle of the sewing machine, and the sewing pattern corresponds to the detection information: an estimation portion, configured to estimate the sewing pattern of the sewing machine based on the pattern information and the detection information of the sewing needle detected by a detection device; and an obtaining portion, configured to obtain operation information of the sewing machine having the estimated sewing pattern.

(3) Beneficial Effects

According to the present application, the operation information of the sewing machine may be effectively utilized.

REFERENCE NUMERALS

1: sewing management system;
10: operation information collection system;
11: management server;
20, 30: sewing machine;
50: detection device;
100: operation information obtaining device;
110: control portion;
111: estimation portion;
112: obtaining portion;
113: collection portion;
120: storage portion;
121: program;
122: device information;
123: sewing machine information;
124: detection information;
130: display portion;
140: input portion;
150: communication portion;
200; operation information;
500: pattern information;
SG: pulse train;
PT: sewing pattern;
PM: seam;
PG: pulse group.

DETAILED DESCRIPTION

The embodiments of the present application are described below with reference to the accompanying drawings, but the present application is not limited to the embodiments.

An Outline Structure of a Sewing Management System

Figure 1:
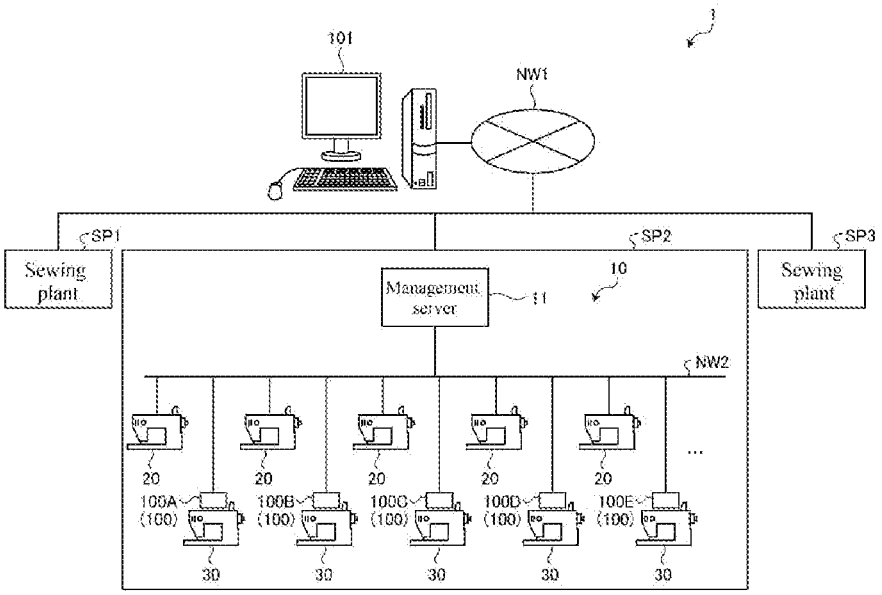
FIG. 1 is a structural diagram of a sewing management system according to an embodiment of the present application.

FIG. 1 is a structural diagram of a sewing management system according to an embodiment of the present application. As shown in FIG. 1, the sewing management system 1 includes operation information collection systems 10 and a management terminal 101. The operation information collection system 10 is constructed for each sewing plant with respect to sewing machines belonging to sewing plants SP1 to SP3. The management terminal 101 is communicatively and respectively connected to a plurality of the operation information collection systems 10. In addition, only the structure of the operation information collection system 10 for the sewing plant SP2 is shown in FIG. 1, and diagrams of the operation information collection systems 10 for the sewing plants SP1 and SP3 are omitted since each of the operation information collection systems 10 for the sewing plants SP1 to SP3 has the same structure.

The operation information collection systems 10 for the plurality of the sewing plants SP1 to SP3 are connected to the management terminal 101 through network NW1 such as the Internet. All the operation information collected by the operation information collection system 10 for each of the sewing plants SP1 to SP3 may be sent to the management terminal 101 or may be viewed in the management terminal 101. A manager may confirm operation condition etc. of each of the sewing plants SP1 to SP3 from the management terminal 101. The manager may, for example, change settings of various parameters related to sewing in each of the sewing plants SP1 to SP3 through the management terminal 101 by confirming the operation condition etc. In addition, the management terminal 101 is composed of conventional personal computers (PCs), tablet PCs, or smart devices (smart phones, smart watches, smart glasses, etc.).

In each of the sewing plants SP1 to SP3, a plurality of the sewing machines with different manufacturers, models, specifications, and years of manufacturing constitute a sewing production line. Strictly speaking, there are a wide variety of the sewing machines constituting the sewing production line, but these sewing machines may generally be classified into two types: a sewing machine 20 and a sewing machine 30. Namely, the sewing machine 20 belonging to one classification is equipped with an equipped detection device that detects a state change of a structure of the sewing machine, and has a function of outputting the detection information or operation information based on the detection information to the outside. It should be noted that the term "equipped" here refers to being equipped to the sewing machine initially, and does not include a detection device added in a following modification, or an external detection device not belonging to the equipment of the sewing machine. In addition, the sewing machine 30 belonging to another classification does not include an equipped detection device that detects a state change of the structure of the sewing machine, or does not include a function of outputting detection information of an equipped detection device or operation information based on the detection information to the outside.

The operation information collection system 10 for each of the sewing plants SP1 to SP3 includes: a plurality of the sewing machines 20 belonging to the sewing production line: a plurality of the sewing machines 30 belonging to the sewing production line and operation information obtaining devices 100 separately attached to the sewing machines 30; and a management server 11, which is used as a collection device, collects the operation information from each of the sewing machines 20, and collects the operation information from each of the sewing machines 30 through the operation information obtaining device 100. The management server 11, each of the sewing machines 20, and each of the operation information obtaining devices 100 are connected to a network NW2 of the operation information collection system 10.

The sewing machine 20 and the sewing machine 30 include, for example: a main shaft motor: a main shaft, driven rotationally through the main shaft motor: a needle rod and a sewing needle, reciprocating up and down with power from the main shaft: a thread take-up lever component, reciprocating up and down at a same period as the needle rod: a shuttle or a looper, wrapping a lower thread around an upper thread of the sewing needle; a fabric feeding mechanism, conveying fabric at a specified seam spacing: and a thread trimming device, trimming the upper thread and the lower thread.

Figure 2:
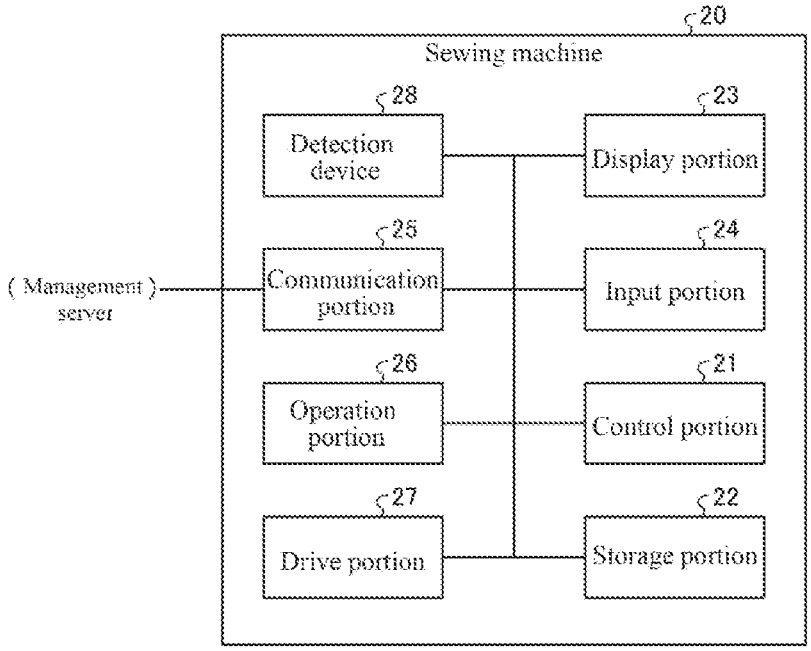
FIG. 2 is a block diagram showing a control system of a sewing machine.

FIG. 2 is a block diagram showing a control system of the sewing machine 20. As shown in FIG. 2, the sewing machine 20 includes: a control portion 21, controlling the entire sewing machine 20; a storage portion 22, connected to the control portion 21: a display portion 23; an input portion 24; a communication portion 25; an operation portion 26; and a drive portion 27. The control portion 21 is composed of central computing devices, such as central processing unit (CPU). The storage portion 22 stores a program executed by the control portion 21 and functions as a working area of the control portion 21.

The display portion 23 displays information required for an action of the sewing machine 20. The input portion 24 receives an input of an instruction or a setting from an operator. The communication portion 25 communicates with the management server 11 through the network NW2. For example, the communication portion 25 sends the operation information of the sewing machine 20 to the management server 11.

The handling section 26 receives a sewing-related operation from the operator. For example, the operation portion 26 receives a drive operation for a sewing from the operator (such as executing sewing start, sewing stop, reverse feed, thread trimming, etc.). The drive portion 27 includes: the main shaft motor mentioned above, an actuator for executing the thread trimming, an actuator for changing the seam spacing, and other drive sources related to various sewing actions.

The detection device 28 is an equipped detection device equipped on the sewing machine 20, and belongs to a sensor class used to detect detection information for obtaining the operation information Examples of the operation information are "operation time". "number of stitches", "sewing speed". "number of thread trimmings", "yield", and other information may also be obtained. The detection device 28 is an encoder detecting a rotational speed of the main shaft motor. In addition, other detection devices may also be added based on the type of the operation information.

The "operation time" as the operation information refers to the elapsed time from a start of a sewing to an end. The encoder may detect a start and a stop of a drive of the main shaft motor, and the control portion 21 may count the elapsed time from the start of the drive to the stop to obtain the "operation time". The "number of stitches" as the operation information refers to a cumulative number of needle drops during a sewing, which may be obtained from a cumulative value of a rotational speed of the main shaft motor detected by the encoder. The "sewing speed" as the operation information refers to an average number of needle drops per unit time during a sewing, which may be obtained from the rotational speed of the main shaft motor detected by the encoder. The "number of thread trimmings" as the operation information refers to a cumulative execution number of thread trimmings, which may be obtained by counting an input of the thread trimming instruction detected by the operation portion 26. The "yield" as the operation information refers to the number of sewn articles completed. Due to a fixed number of thread trimmings to be performed on a sewn article, the "yield" may be determined by dividing the "number of thread trimmings" by the number of thread trimmings to be performed on one sewn article. In addition, the number of thread trimmings to one sewn article is pre-determined and input by the input portion 24.

The above operation information is obtained by a detection etc., of the detection device 28, and a comparison to a built-in clock of the control unit 21, and the operation information is temporarily stored in the storage portion 22. In addition, the control portion 21 periodically, or at a specified time, or based on a requirement from the management server 11, sends the obtained operation information to the management server 11.

On the other hand, the plurality of the sewing machines 30 are not limited to a same model, and the structures may vary in individual cases. Sewing machine 30 includes, at least, the operation portion and the drive portion, which is the same as sewing machine 20, but does not include a detection device for obtaining the operation information or a communication portion for sending information to the outside. Therefore, it is not possible to send operation information from the sewing machine 30 to the management server 11. Therefore, an operation information obtaining device 100 is separately attached to the sewing machine 30 for obtaining the operation information from outside the sewing machine.

Operation Information Obtaining Device

Figure 3:
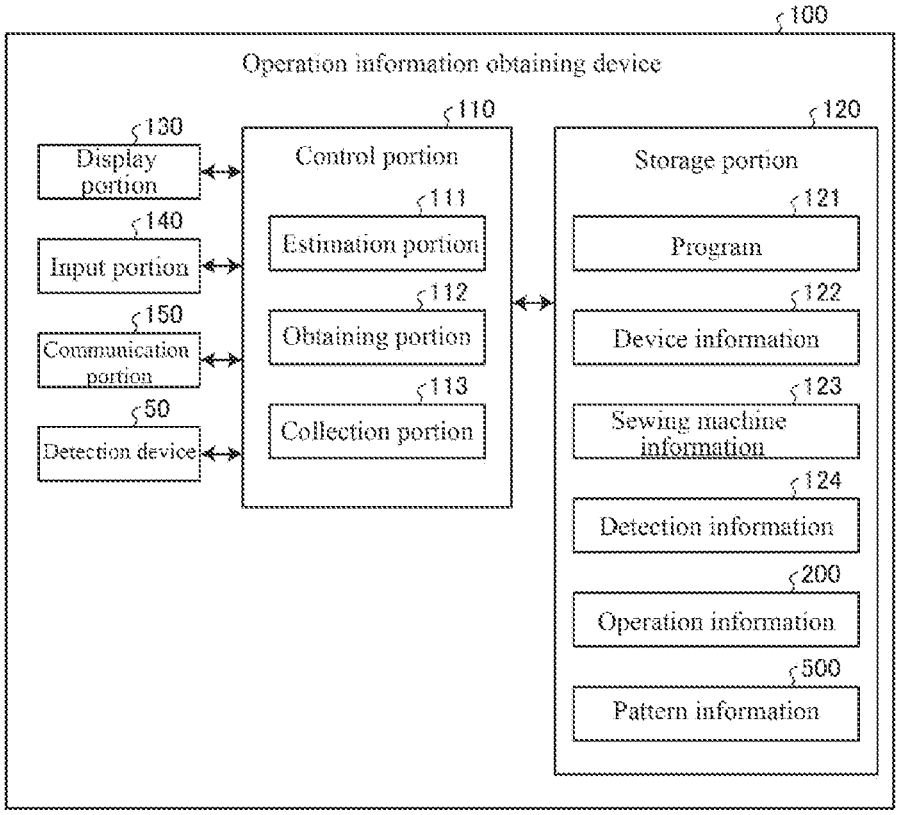
FIG. 3 is a block diagram showing a control system of an operation information obtaining device.

FIG. 3 is a block diagram showing a control system of the operation information obtaining device 100. In addition, in an example shown in FIG. 3, the operation information obtaining device 100 illustrates five devices from the operation information obtaining device 100A to 100E, which are recorded as "operation information obtaining device 100" without repeating the explanation when explaining the common content. In addition, when explaining the differences, the operation information obtaining devices 100A. 100B, 100C, 100D, and 100E are recorded and described separately.

As shown in FIG. 3, the operation information obtaining device 100 includes: a control portion 110, executing a processing or a control for obtaining detection information 124 of a detection device 50; a storage portion 120, connected to the control portion 110: a display portion 130: an input portion 140; a communication portion 150; and the detection device 50. The control portion 110 is composed of a central computing device such as a CPU. The storage portion 120 stores a program executed by the control portion 110 and plays functions as a working area of the control portion 110.

The storage portion 120 may store various information such as a program 121, device information 122, sewing machine information 123, detection information 124, operation information 200, pattern information 500, etc. The program 121 is a program that causes the control portion 110 to execute a function for implementing various actions related to the operation information obtaining device 100. The device information 122 includes inherent information of the operation information obtaining device 100, such as the acquisition device ID. The sewing machine information 123 includes information such as a sewing machine ID of the sewing machine 30 being assigned to be equipped with the operation information obtaining device 100. The detection information 124 includes information capable of identifying an action of the sewing needle of the sewing machine 30. The operation information 200 includes information related to an operation of the sewing machine 30 based on a detection result of the detection device 50. The pattern information 500 includes information that may associate the detection information capable of identifying the action of the sewing needle of the sewing machine 30 and the sewing pattern of the sewing machine 30 corresponding to the detection information. An example of the operation information 200 and the pattern information 500 will be described later.

The display portion 130 displays information and a set value required for obtaining the operation information 200. The input portion 140 receives an input from the operator of the set value required by the acquisition of the operation information 200. The communication portion 150 communicates with the management server 11 through the network NW2. For example, the communication portion 150 sends the detection information 124 and the operation information 200 detected from the sewing machine 30 to the management server 11.

The detection device 50 is an external detection device that detects a sewing action of the sewing machine 30 from an outside of a main frame 301 described later. The detection device 50 is a sensor type that detects the detection information 124 for obtaining the operation information 200 of the sewing machine 30. The detailed information about the sensor class will be described later. The detection device 50 provides the detection information 124 indicating a detection result to the control portion 110. The detection information 124 includes, for example, various information such as a rotation sensor signal during sewing a pattern of the sewing machine 30, and detection state of the sewing needle. In the operation information 200 obtained by the operation information obtaining device 100, "operation time", "number of stitches", "sewing speed", "number of thread trimmings", "yield", "sewing pattern", "poor condition", etc. may be listed. The operation information 200 further includes information other than the above. The method for obtaining the operation information 200 by the operation information obtaining device 100 will be described later.

The operation information obtaining devices 100A to 100E may include detection devices 50 detecting different objects. In the following description, it is assumed that the operation information obtaining devices 100A to 100E include the same detection device 50.

Figure 4:
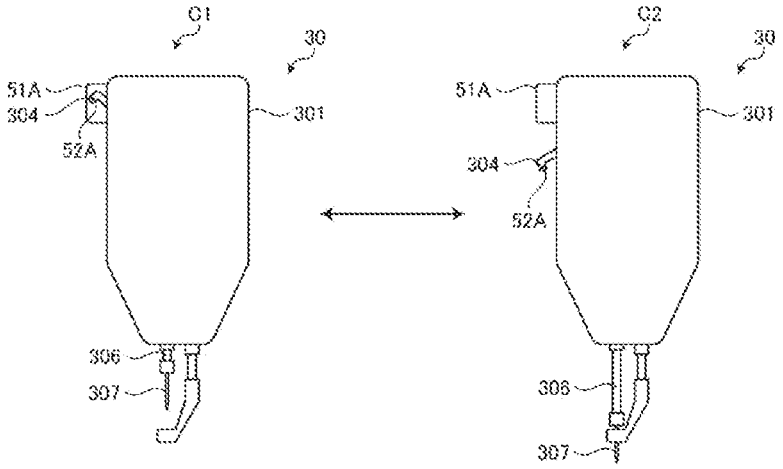
FIG. 4 is a partial side view of a sewing machine showing an example of a detection state of a photoelectric sensor.

FIG. 4 is a partial side view of a sewing machine showing an example of a detection state of a photoelectric sensor. As shown in FIG. 4, the detection device 50 of the operation information obtaining device 100 includes: a photoelectric sensor 51A, a current sensor, a light-emitting portion, a light sensor, and a yield switch not shown in the figure. The photoelectric sensor SIA is provided outside the main frame 301 of the sewing machine 30 to detect a state change of an action component that performs a periodic action with the same period as the up and down action of the sewing needle 307. The current sensor is a current detection device that detects energization from the outer side of the current cable through which the motor current of the main shaft motor flows. The main shaft motor is pulled out from the main frame 301 to the outside. The light-emitting portion includes a power lamp that emits light when a main power source of the sewing machine 30 is turned on. The light sensor is a light detection device that detects a luminous state of the light-emitting portion. The yield switch is a yield input portion that detects a yield through an operation of the operator using the sewing machine 30. It should be noted that the detection device 50 of the operation information obtaining device 100 includes at least the photoelectric sensor 51A, but may do not include the current sensor, the light sensor, and the yield switch.

A state C1 in FIG. 4 represents a detection state of the photoelectric sensor 51A. A state C2 in FIG. 4 represents a non-detection state of the photoelectric sensor 51A. The photoelectric sensor 51A detects a presence or an absence of the thread take-up lever component 304, the thread take-up lever component 304 serves as the action component that performs a periodic action at the same period as the up and down action of the sewing needle 307. An end portion of the thread take-up lever component 304, in which a threading hole for passing the upper thread is formed, extends outwardly from a front side (a surface opposite to the operator) of a sewing machine arm portion of the main frame 301. The thread take-up lever component 304 receives power from a rotation of the main shaft, and a front end of the thread take-up lever component 304 reciprocally oscillates up and down in the same period as the up and down action of the sewing needle 307. An upper stop point in the reciprocating oscillation of the thread take-up lever component 304 is consistent with a stop position of the needle rod (stopping in a state where the sewing needle 307 retreats above a throat plate), which is a stop position of the main shaft at a stop of the sewing of the sewing machine 30.

The photoelectric sensor 51A is a reflective type including a light-emitting element and a light-receiving element facing in the same direction, and can detect a presence or an absence of an object directly opposite to a detection surface of the photoelectric sensor 51A through a presence or an absence of a reflected light. The photoelectric sensor 51A is installed on an external front side of the sewing machine arm portion of the main frame 301 so that the detection surface of the photoelectric sensor 51A may be directly opposite to a position at which the front end of the thread take-up lever component 304 at the upper stop point may be detected. In addition, a reflective sheet 52A is provided at the front end of the thread take-up lever component 304 in a configuration opposite to the photoelectric sensor 51A. Even without the reflective sheet 52A, the photoelectric sensor 51A may still detect the front end of the thread take-up lever component 304. However, by providing the reflective sheet 52A, a better detection may be performed. The photoelectric sensor 51A may be fixed using any method such as bonding, thread fastening, or thread fastening through a bracket. In addition, the photoelectric sensor 51A may not be directly installed on a surface of the main frame 301, for example, the photoelectric sensor 51A may be supported by a support body on a front side of the main frame 301 of the sewing machine 30.

The detection device for detecting the front end of the thread take-up lever component 304 is not limited to a reflective type photoelectric sensor, but may be a transmissive type photoelectric sensor. Furthermore, it is possible to use not only the photoelectric sensor 51A, but also all sensors capable of detecting a presence or an absence of the front end of the thread take-up lever component 304. For example, a distance detection sensor may be used to detect a proximity of the front end of the thread take-up lever component 304, or a sensor that utilizes magnetism or ultrasound to detect the proximity of the front end of the thread take-up lever component 304 may be used.

Figure 5:
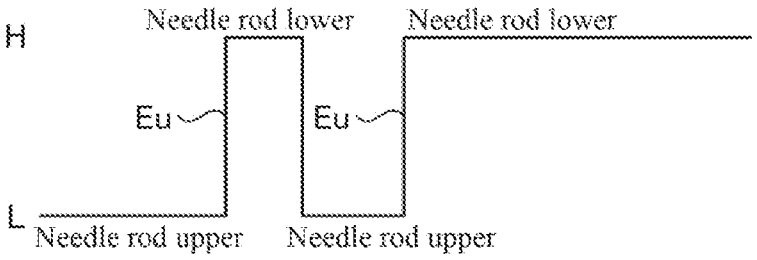
FIG. 5 is a first output line diagram showing an example of signal detection for the photoelectric sensor.
Figure 6:
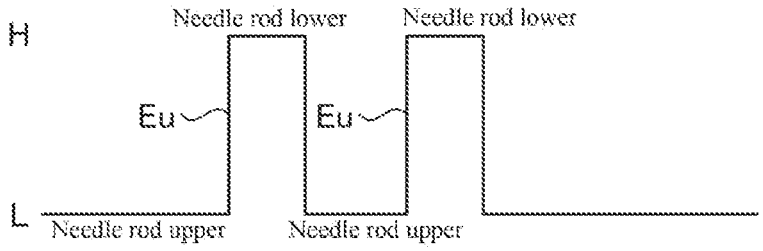
FIG. 6 is a second output line diagram showing an example of signal detection for the photoelectric sensor.
Figure 7:
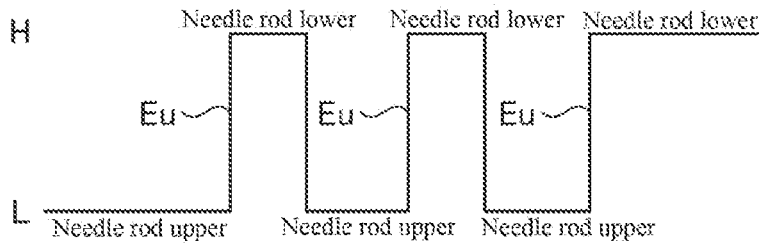
FIG. 7 is a third output line diagram showing an example of signal detection for the photoelectric sensor.

FIGS. 5 to 7 show examples of signal detection for the photoelectric sensor 51A. FIGS. 5 to 7 are output line diagrams showing examples of signal detection for the photoelectric sensor. In FIGS. 5 to 7, the detection state of the photoelectric sensor 51A on the front end of the thread take-up lever component 304 is set to L, and the non-detection state is set to H. The detection of the photoelectric sensor 51A indicates a state in which the main shaft motor is stopped at a needle rod upper stop position when the state L is continuous. The detection of the photoelectric sensor 51A indicates a state in which the main shaft motor is stopped at a needle rod lower stop position when the state H is continuous.

As shown in FIGS. 5 to 7, when the detection of the photoelectric sensor 51A repeats the state H and the state L in a short period of time, the control portion 110 may detect the "number of stitches" by counting the number of times of a rising edge Eu indicating a transition from the state L to the state H. For example, in FIG. 5, since the rising edge Eu occurs twice and is stopped, the number of stitches is counted as 2. In FIG. 6, the number of stitches is counted as 2, and in FIG. 7, the number of stitches is counted as 3.

In addition, the control portion 110 may determine a stop of the main shaft motor when it is detected that the state L or the state H continues a predetermined stop determination time t1 or more. The stop determination time t1 for determining the stop may be arbitrarily set from an input portion 44. For example, the stop determination time t1 may be set to a value equal to 0.6 [s], which is a period of a very low main shaft rational speed 100 spm without a normal sewing. Moreover, the control portion 110 may count the elapsed time from the detection of an initial rising edge Eu to a final rising edge Eu before the stop, and obtain the "operating time" from this elapsed time. Furthermore, the control portion 110 may obtain the "sewing speed" by dividing the obtained "number of stitches" by the obtained "operation time".

For example, in FIG. 5, since the detection of the photoelectric sensor 51A continues in the state H at the time of stopping, the control portion 110 determines that the control has stopped at the lower stop position of the needle rod. On the other hand, in FIG. 6, since the detection of the photoelectric sensor 51A continues in the state L at the time of stopping, the control portion 110 determines that the control has stopped at the upper stop position of the needle rod. The stopping at the lower stop position of the needle rod is usually handled as follows, maintaining a state where the sewing needle 307 pierces to the fabric and is constrained, and then the sewing is resumed by changing a direction of the needle.

In contrast, the stopping at the upper stop position of the needle rod is usually handled as follows: the fabric is in a state where the fabric is unconstrained by the sewing needle 307, the sewing is finished, and the thread is shifted to thread trimming. Therefore, as shown in FIG. 6, in the case where the control portion 110 is stopped at the upper stop position of the needle rod, it is considered that the thread trimming has been executed, and the "number of thread trimmings" is counted and a value of the "number of thread trimmings" may be obtained.

In addition, the photoelectric sensor 51A and the reflective sheet 52A (or the thread take-up lever component 304) are configured to detect the upper stop position of the thread take-up lever component 304, but the lower stop position of the needle rod may also be detected by changing these configurations. In this case, instead of counting the "number of thread trimmings" by detecting the stopping at the upper stop position of the needle rod, the "number of thread trimmings" may be counted by detecting the stopping in a state that the lower stop position of the needle rod is not detected.

As in the case of the sewing machine 20, since the number of thread trimmings to be performed on one sewn article is determined, the control portion 110 calculates the "yield" by dividing the "number of thread trimmings" by the number of thread trimmings x to be performed on one sewn article. In addition, the number of thread trimmings x to be performed on one sewn article may be arbitrarily set by the input portion 140 in advance.

The control portion 110 may obtain the operation information 200 based on the detection signal of the photoelectric sensor 51A when an inching is performed. The inching refers to a low-speed sewing of one stitch at a time to align the needle dropping position at the corners, etc. Due to the fact that the inching is a one-stitch drop during a sewing procedure, a one-stitch drop is performed from a state of the stopping at the lower stop position of the needle rod, and then stops again at the lower stop position of the needle rod. Therefore, during a process in which the detection of the photoelectric sensor 51A is stopped in the state H, a rising edge Eu is detected once, and a stop in the state H is detected again, and the execution of inching may be detected.

During the inching, due to the rising edge Eu is only detected once, the "number of stitches"=1, and the above "operation time" cannot be calculated, correspondingly, the "sewing speed" cannot be calculated. Therefore, considering that the inching is generally carried out at a low speed, assuming that the inching is carried out at the lowest sewing speed of 300 [spm] in a conventional sewing machine, and when the "inching" is detected, the operation information 200 is obtained with the "number of stitches" of 1, the "operation time" of 0.2 [s], and the "sewing speed" of 300 [spm]. In addition, the operation time t2 during the inching may be arbitrarily set by the input portion 44.

In addition, the detection device 50 may also be a structure that detects a rotation of a pulley, and the pulley serves as an action component that performs a periodic action with the same period as the up and down action of the sewing needle 307. The pulley is located on a side of the main frame 301 of the sewing machine 30, and the pulley is configured to be exposed from the outside and may be manually rotated from the outside. The pulley 305 is connected to the main shaft and rotates in conjunction with the main shaft. Therefore, the pulley rotates at the same period as the up and down action of the sewing needle 307.

For example, the reflective sheet is pasted near a specified position of a peripheral surface or a periphery of a circular end face of the pulley, and the detection device 50 is configured near the sewing machine 30 or on a surface of the main frame 301 of the sewing machine 30 in such a manner: the photoelectric sensor irradiates a detection light to a position of the reflective sheet at the upper stop position of the needle rod. As for the detection device 50, through structures of the photoelectric sensor and the reflective sheets, the photoelectric sensors may detect the upper stop position of the needle rod of the sewing machine 30 from a change in a light intensity of a reflected light of the detection light. Specifically, at the upper stop position of the needle rod of the sewing machine 30, the reflective sheet reflects the detection light, and the photoelectric sensor is in a high-light-intensity detection state. In addition, at positions other than the upper stop position of the needle rod of the sewing machine 30, the photoelectric sensor is in a low-light-intensity detection state because the reflective sheet is located in a position that does not reflect the detection light.

In this case, the detection device 50 replaces the high-light-intensity detection state with the state L of the detection of the photoelectric sensor 51A, and replaces the low-light-intensity detection state with the state H of the detection of the photoelectric sensor 51A. Thus, it is possible to detect the "operation time", "number of stitches". "sewing speed", "number of thread trimmings", "yield", etc. as the operation information 200.

It should be noted that the detection device for detecting a specific part of the pulley is not limited to the photoelectric sensor, and all sensors capable of detecting a proximity to the specified position of the specific part of the pulley may be used. For example, a protrusion may be provided instead of the reflective sheet of the pulley, and a proximity of a specific part of the pulley may be detected through a distance detection sensor. Alternatively, a magnetic member may be pasted instead of the reflective sheet of the pulley, and a magnetic sensor may be used for detection.

Returning to FIG. 3, the control portion 110 includes functional portions such as: an estimation portion 111, an obtaining portion 112, a collection portion 113. The control portion 110 implements functional portions such as the estimation portion 111, the obtaining portion 112, and the collection portion 113 by executing the program 121. The program 121 is a program used to enable the control portion 110 of the operation information obtaining device 100 to function as the estimation portion 111, the obtaining portion 112, and the collection portion 113. The control portion 110 implements or performs the information processing functions or usages described below.

The estimation portion 111 estimates the sewing pattern of the sewing machine 30 based on the detection information 124 and the pattern information 500 of the sewing needle 307 detected by the detection device 50. The sewing pattern includes a figure, shape, design, and other patterns formed by the sewing machine 30 on the fabric and other to-be-sewing articles. The pattern of the sewing machine 30 is sewn based on the determined number of stitches, thread trimming position, and sewing time. Therefore, an action of the needle 307 (the main shaft) of the sewing machine 30 is a determined action corresponding to the sewing pattern. The detection device 50 outputs the detection information 124 that detects a pulse signal of the rotation sensor corresponding to the action of the sewing needle 307 (the main shaft) of the sewing machine 30.

For example, the estimation portion 111 extracts, from the pattern information 500, patterns similar to a shape and a pattern of a certain pulse train, represented by the detection information 124 during a pattern sewing, of the rotation sensor, and estimates the sewing pattern associated with the extracted pattern as the sewing pattern of the sewing machine 30. Based on the detection information 124 that may identify a periodic action and a non-action state of the sewing needle 307 and the pattern information 500, the estimation portion 111 estimates the sewing pattern with a sewing and an idle feeding of the sewing machine 30. The estimation portion 111 estimates the poor condition of the sewing of the sewing machine 30 based on the detection information 124 and the pattern information 500. An example of determination will be described later. The estimation portion 111 stores the determination result of the sewing pattern of the sewing machine 30 in the storage portion 120.

The obtaining portion 112 obtains the operation information 200 of the sewing machine 30 including the estimated sewing pattern. Obtaining the operation information 200 includes generating the operation information 200. The obtaining portion 112 obtains, for example, the operation information 200 that may identify the estimated sewing pattern and the action state of the sewing needle 307, and stores the estimated sewing pattern and the action state of the sewing needle 307 in the storage portion 120. The obtaining portion 112 obtains the operation information 200 that may identify the poor condition of the sewing of the sewing machine 30 determined by the estimation portion 111. The obtaining portion 112 may store the obtained operation information 200 in an external storage device or provide the obtained operation information 200 to the management server 11, the management terminal 101, etc.

The collection portion 113 collects the detection information 124 of the sewing machine 30 that has executed the sewing pattern, and stores the pattern information 500 associating the detection information 124 with the sewing pattern in the storage portion 120. The collection portion 113 performs teaching processing that associates the information of the sewing pattern input through the input portion 140 with the detection information 124 detected by the detection device 50, generates the pattern information 500, and stores the pattern information 500 in the storage portion 120.

The above describes the functional structure example of the operation information obtaining device 100 of this embodiment. In addition, the above structure illustrated using FIG. 3 is only an example, and the functional structure of the operation information obtaining device 100 of this embodiment is not limited to this example. The functional structure of the operation information obtaining device 100 of this embodiment may be flexibly deformed based on specifications and applications.

Figure 8:
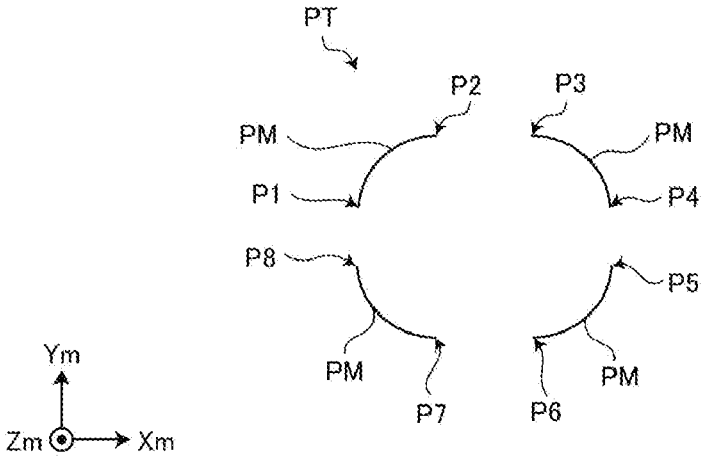
FIG. 8 shows an example of a sewing pattern of an operation information obtaining device of the present application.
Figures 9, 10:
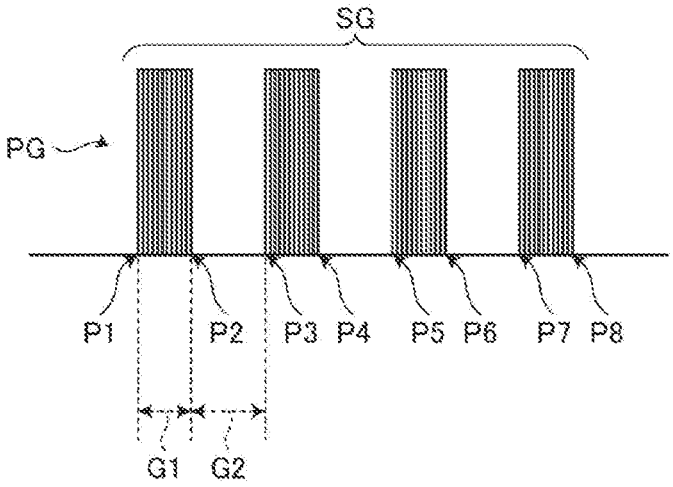
FIG. 9 shows an example of a pulse train corresponding to FIG. 8.
FIG. 10 shows an example of a relationship between a sewing point of a seam and an action of a sewing machine.
Figures 11, 12:
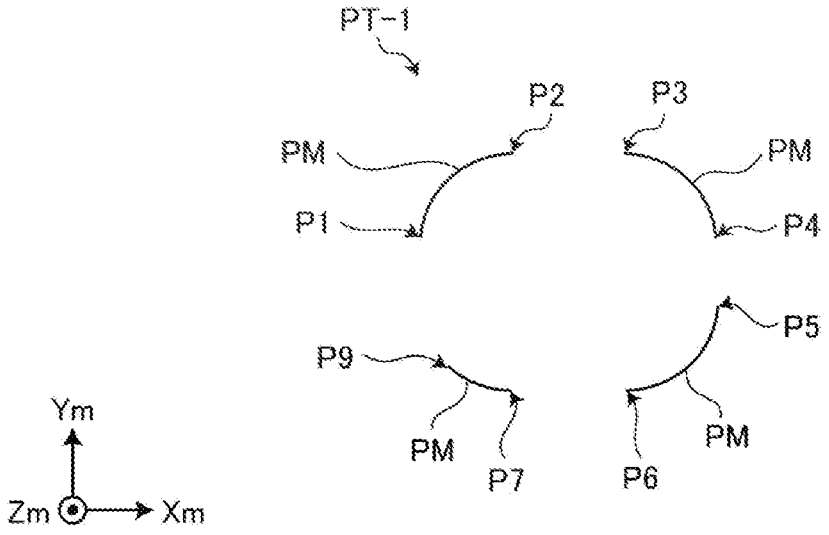
FIG. 11 shows an example of pattern information according to an embodiment of the present application.
FIG. 12 is a diagram for illustrating an example of a poor condition of a sewing pattern.

FIG. 8 shows an example of a sewing pattern of the operation information obtaining device 100 of the present application. FIG. 9 shows an example of a pulse train corresponding to FIG. 8. FIG. 10 shows an example of a relationship between a sewing point of a seam and an action of a sewing machine. FIG. 11 shows an example of the pattern information 500 according to an embodiment of the present application.

In the implementation, the positional relationship of each part is described based on a sewing machine coordinate system defined in the sewing machine 30. As shown in FIG. 8, the sewing machine coordinate system is defined by a three-dimensional orthogonal coordinate system. The coordinate system of the sewing machine is defined by an Xm axis, a Ym axis, and a Zm axis. The Xm axis is defined on a predetermined plane. The Ym axis is defined to be orthogonal to the Xm axis on the predetermined plane. The Zm axis is defined to be orthogonal to the predetermined plane. In the implementation, it is set that the predetermined plane is parallel to a horizontal plane, and a direction parallel to the Zm axis is an up-and-down direction. In addition, in the implementation, the predetermined surface is appropriately referred to as an XmYm plane.

The sewing machine 30 holds the upper end of the sewing needle 307 so that the sewing needle 307 extends in the Zm axis. In the sewing machine 30, an upper thread is threaded in the sewing needle 307. The sewing machine 30 supports a back of the to-be-sewn article through the throat plate. An upper surface of the throat plate is parallel to the XmYm plane. The throat plate supports the to-be-sewn article from below. The throat plate includes a needle hole through which the sewing needle 307 may pass. The sewing machine 30 is provided with a shuttle below the throat plate, the shuttle holds a bobbin housed in a bobbin case. In the sewing machine 30, a lower thread is wound on the bobbin. The shuttle of the sewing machine 30 rotates synchronously with the reciprocating movement of the needle rod, and the lower thread is fed from the shuttle.

The sewing machine 30 presses the to-be-sewn article from above through a pressing component. The pressing component is provided above the throat plate and in contact with the surface of the to-be-sewn article. The pressing component holds the to-be-sewn article between the throat plate and the pressing component. When the needle rod of the sewing machine 30 is lowered, the sewing needle 307 held by the needle rod penetrates the to-be-sewn article and passes through the needle hole provided on the throat plate. When the sewing needle 307 passes through the needle hole of the throat plate, the sewing machine 30 hangs the lower thread fed from the shuttle on the upper thread hanging on sewing needle 307. When in a state where the lower thread is hung on the upper thread, the sewing needle 307 rises and leaves from the to-be-sewn article. When sewing needle 307 penetrates through the to-be-sewn article, the to-be-sewn article stops. When sewing needle 307 leaves from the to-be-sewn article, the to-be-sewn article moves towards a sewing direction corresponding to the sewing pattern PT through the feeding mechanism of the sewing machine 30. The sewing machine 30 repeatedly moves and stops in the sewing direction of the to-be-sewn article while causing the sewing needle 307 to move back and forth, thereby forming a seam PM on the to-be-sewn article. The seam PM formed on the to-be-sewn article becomes the shape corresponding to the sewing pattern PT.

Example of the Sewing Pattern

As shown in FIG. 8, the sewing machine 30 forms a seam PM on the to-be-sewn article by operating sewing needle 307 to form the sewing pattern PT. In an example shown in FIG. 8, the sewing pattern PT has a plurality of curved seams PM, and a roughly circular pattern is formed through the plurality of seams PM. The sewing point P1 of the pattern PT is a starting position for pattern sewing, and the sewing point P8 is an ending position for pattern sewing. The sewing points P2 to P7 of the sewing pattern PT are the positions where the state of pattern sewing changes. The state of pattern sewing includes, for example, sewing, thread trimming, and idle feeding etc. In addition, the sewing pattern PT may also be, for example, a pattern with shapes such as lines, circles, polygons, or a combination of these shapes.

As shown in FIG. 9, when the sewing machine 30 performs sewing based on sewing pattern PT, the detection device 50 detects a pulse signal indicating the action state of the main shaft motor of the sewing machine 30, and obtains the detection information 124 indicating the pulse train SG. The detection information 124, for example, includes information that may identify the pattern, numbers, time, and other information of the pulse train SG from sewing point P1 to sewing point P2, from sewing point P3 to sewing point P4, from sewing point P5 to sewing point P6, and from sewing point P7 to sewing point P8. That is, the pulse train SG represents the switching from the state L to the state H mentioned above. The pulse train SG may be used to detect a start and an end of pattern sewing by treating the pulse group PG as a block. The pulse train SG, for example, may identify the number of stitches and the sewing time of the seam PM by counting the number of pulses in the pulse group PG from a start of sewing (sewing point P1) to the thread trimming (sewing point P2).

The pulse train SG includes a first state G1 and a second state G2. The first state G1 represents a periodic action state of sewing needle 307, including a pulse group PG corresponding to the number of stitches of the sewing needle 307. The second state G2 represents the state where the sewing needle 307 is not in action and does not include a pulse group PG. For each of the plurality of sewing patterns PT, the time, number of pulses, and combination of the first state G1 and second state G2 of the pulse train SG are different. In this way, the pulse train SG may represent the corresponding pulse train SG of the sewing pattern PT as a combination of a plurality of the first state G1 and the second state G2. For example, in the pattern PT shown in FIG. 8 and the pattern PT of seam PM with different shapes and lengths compared to FIG. 8, the combination of the first state G1 and the second state G2 of the pulse train SG is different. Therefore, the operation information obtaining device 100 may determine the sewing pattern PT by comparing the actual detected detection information 124 with the pulse train SG.

As shown in FIG. 10, the sewing points P1 to P2 of the pulse train SG represent sewing, and the sewing point P2 represents the thread trimming. The sewing points P2 to P3 of the pulse train SG represent an idle feeding of the sewing machine 30. The idle feeding refers to not using the sewing needle 307 to form the seam PM. The sewing points P3 to P4 of the pulse train SG represent sewing, and P4 represents the thread trimming. The sewing points P4 to P5 of the pulse train SG represent the idle feeding of the sewing machine 30. The sewing points P5 to P6 of the pulse train SG represent sewing, and the sewing point P6 represents a position of the thread trimming. The sewing points P6 to P7 of the pulse train SG represent a position of the idle feeding of the sewing machine 30. The sewing points P7 to P8 of the pulse train SG represent sewing, and the sewing point P8 represents the thread trimming and the pattern sewing is completed.

The sewing pattern PT and the pulse train SG may associate their respective sewing points P1 to P8. The pattern information 500 includes information that associates the sewing pattern PT with the pulse train SG. In this embodiment, the operation information obtaining device 100 stores a plurality of pattern information 500 based on the detection information 124 of pulse trains SG corresponding to different sewing patterns PT in the storage portion 120. The pattern information 500 associates the detection information 124 of the pulse train SG corresponding to an action of the sewing needle 307 of the sewing machine 30 with the pattern ID indicating the sewing pattern PT of the sewing machine 30 corresponding to the detection information 124.

As shown in FIG. 11, the collection portion 113 collects a plurality of pattern information 500 associating the sewing pattern with the detection information 124 through a teaching function. For example, when a sewing pattern is input through the input portion 140, the collection portion 113 obtains the measurement information 124 when the sewing pattern is actually sewn, and generates the pattern information 500 that associates the detection information 124 with the sewing pattern information. The collection portion 113 generates the pattern information 500 according to different sewing patterns, as to store a plurality of pattern information 500 in the storage portion 120, the external storage device, etc. In an example shown in FIG. 11, pattern information 500 associates sewing patterns PID-1. PID-2, and PID-3 with detection information 124-1, 124-2, and 124-3 in a one-to-one correspondence relationship. The collection portion 113 may be a structure that, for example, collects a plurality of different types of pattern information 500 from a server device and stores the pattern information 500 in the storage portion 120.

FIG. 12 is a diagram for illustrating an example of a poor condition of a sewing pattern PT. As shown in FIG. 12, the sewing machine 30 sometimes stops sewing during pattern sewing due to a poor condition of sewing. In this case, the estimation portion 111 of the operation information obtaining device 100 extracts the pattern information 500 similar to the detection information 124 of the sewing needle 307 detected by the detection device 50 from a plurality of pattern information 500 in the storage portion 120. The estimation portion 111 estimates the sewing pattern of the sewing machine 30 based on the detection information 124 and the extracted pattern information 500, and estimates whether a poor condition of the sewing machine 30 occurs. For example, the estimation portion 111 compares the pulse train SG represented by the detection information 124 with the pulse train SG represented by the pattern information 500, and estimates that the sewing pattern represented by the pattern information 500 is the sewing pattern of the sewing machine 30 when a consistency is higher than a determination threshold.

In an example shown in FIG. 12, regarding the estimation portion 111, the sewing pattern from sewing point P1 to sewing point P7 of the sewing pattern PT-1 is consistent with the sewing pattern PT shown in FIG. 8, and the sewing pattern from sewing point P7 to sewing point P9 is different from the section from sewing point P7 to sewing point P8 of the sewing pattern PT. In this case, due to the fact that sewing point P9 is closer to sewing point P7 than sewing point P8, the estimation portion 111 may estimate that the sewing machine 30 stops sewing in the pattern sewing procedure. The estimation portion 111 estimates that an inconsistent section from sewing point P7 to sewing point P9 is a location where the poor condition occurred, and stores the estimation result in the storage portion 120.

The obtaining portion 112 of the operation information obtaining device 100 obtains the operation information 200 that may identify the poor condition of a sewing of the sewing machine 30. For example, the obtaining portion 112 obtains operation information 200 including the sewing machine ID represented by the sewing machine information 123, and the occurrence of the poor condition, occurring date and time etc. in the sewing pattern PT-1, and stores the operation information 200 in the storage portion 120 etc.

Processing Procedure of the Operation Information Obtaining Device

Figure 13:
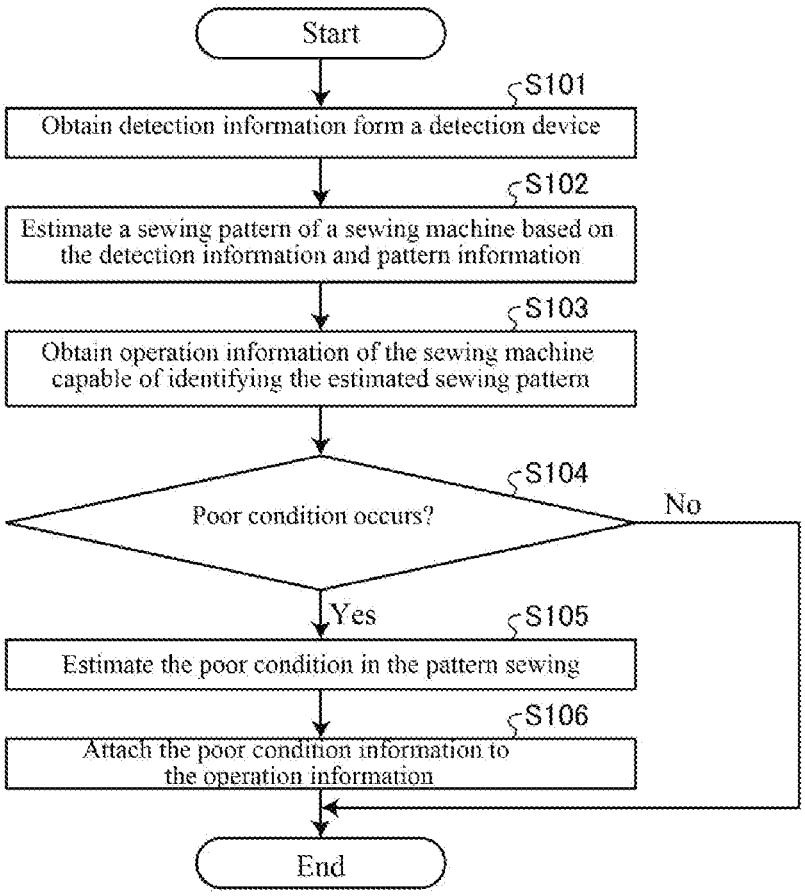
FIG. 13 is a flowchart showing an example of a processing procedure executed by an operation information obtaining device.

Next, an example of the processing procedure of the operation information obtaining device 100 will be described. FIG. 13 is a flowchart showing an example of the processing procedure executed by the operation information obtaining device 100. The processing procedure shown in FIG. 13 may be achieved by executing program 121 by the control portion 110 of the operation information obtaining device 100. The processing procedure shown in FIG. 13 is executed by the control portion 110 at a specified time. The specified time includes an action time of the sewing machine 30, a set time, etc.

As shown in FIG. 13, the control portion 110 of the operation information obtaining device 100 obtains the detection information 124 from the detection device 50 (step S101). For example, the control portion 110 obtains the detection information 124 output by the detection device 50 and stores the detection information 124 in the storage portion 120. When procedure in step S101 is completed, the control portion 110 proceeds the procedure to step S102.

The control portion 110 estimates the sewing pattern of the sewing machine 30 based on the detection information 124 and the pattern information 500 (step S102). For example, the control portion 110 extracts the pattern information 500 similar to the pulse train SG represented by the detection information 124 from the storage portion 120, and estimates the sewing pattern of the sewing machine 30 as the sewing pattern represented by the pattern information 500. When the procedure in step S102 is completed, the control portion 110 proceeds the procedure to step S103.

The control portion 110 obtains the operation information 200 of the sewing machine 30 that may identify the estimated sewing pattern (step S103). For example, the control portion 110 generates the operation information 200 including the detection information 124 obtained in step S101 and the estimated sewing pattern information, obtains the operation information 200 and stores the operation information 200 in the storage portion 120 in chronological order. When the procedure in step S103 is completed, the control portion 110 proceeds the procedure to step S104.

The control portion 110 determines whether a poor condition occurs (step S104). For example, the control portion 110 compares the detection information 124 of sewing needle 307 detected by detection device 50 with similar pattern information 500 corresponding to the sewing pattern PT of the sewing machine 30. When the sewing pattern PT is not completed, it is estimated whether the sewing machine 30 has a poor condition. When the control portion 110 estimates that no poor condition has occurred (No in step S104), the processing procedure shown in FIG. 13 is ended.

In addition, when the control portion 110 estimates that a poor condition has occurred (Yes in step S104), the processing procedure is advanced to step S105. The control portion 110 determines the poor condition in the pattern sewing (step S105). For example, the control portion 110 compares the detection information 124 of the sewing needle 307 with the similar pattern information 500, and it is estimated that the different section of the pulse train SG of the sewing pattern PT is the poor condition in the pattern sewing of the sewing machine 30. When the procedure in step S105 is completed, the control portion 110 proceeds the procedure to step S106.

The control portion 110 attaches the poor condition information to the operation information 200 (step S106). For example, the control portion 110 generates poor condition information that may identify the content, occurrence date and time of the poor condition based on the determination result in step S105, and attaches the poor condition information to the operation information 200 obtained in step S103. The control portion 110 ends the processing procedure shown in FIG. 13 when the procedure in step S106 is completed.

Action Example of the Operation Information Collection System

Next, an example of an action of the operation information obtaining device 100 and the management server 11 in the operation information collection system 11 will be described. The operation information collection system 10 includes an operation information obtaining device 100 for obtaining the operation information 200 of the sewing machine 30, and a collection device for collecting the operation information 200 from the operation information obtaining device 100, namely a management server 11.

Figure 14:
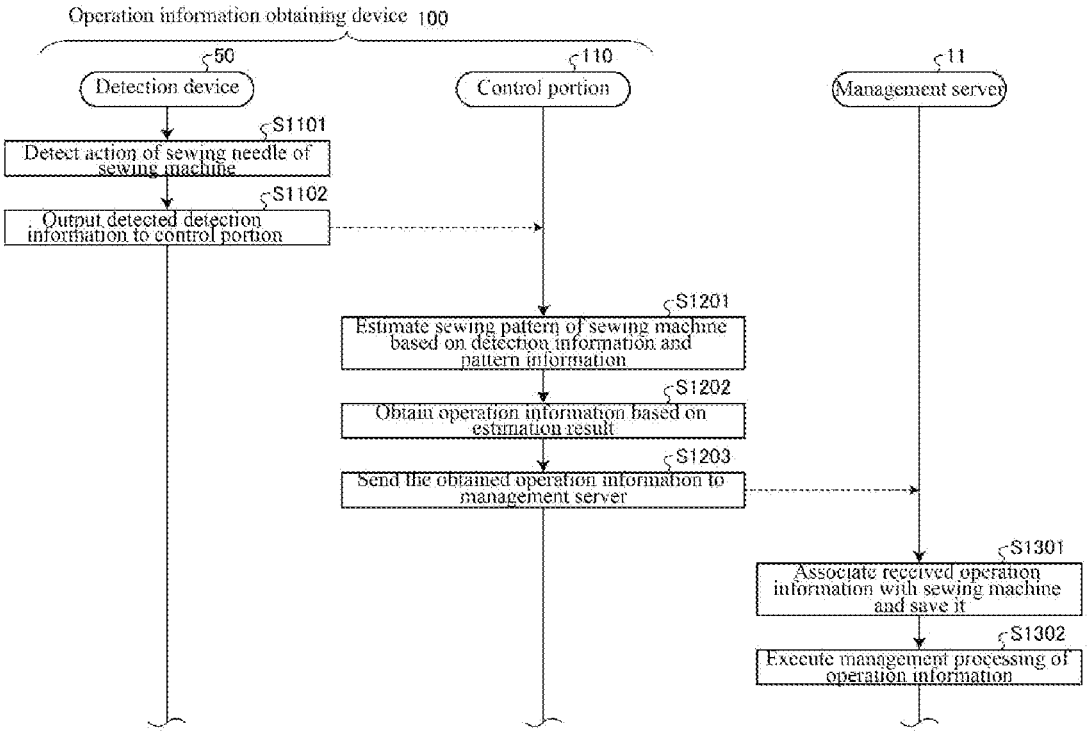
FIG. 14 shows an example of an action of an operation information obtaining device and a management server.

FIG. 14 shows an example of an action of the operation information obtaining device 100 and the management server 11. As shown in FIG. 14, the detection device 50 of the operation information obtaining device 100 detects the action of the sewing needle 307 of the sewing machine 30 (step S1101). The detection device 50 of the operation information obtaining device 100 outputs the detected detection information 124 to the control portion 110 (step S1102).

The control portion 110 of the operation information obtaining device 100 estimates the sewing pattern of the sewing machine 30 based on the detection information 124 and the pattern information 500 (step S1201). The control portion 110 of the operation information obtaining device 100 obtains the operation information 200 based on the estimation result (step S1202). The control portion 110 of the operation information obtaining device 100 sends the obtained operation information 200 (step S1203) In this embodiment, the control portion 110 sends the obtained operation information 200 to the management server 11 through the communication portion 150.

The management server 11 associates the operation information 200 received from the operation information obtaining device 100 with the sewing machine (step S1301) and save them. For example, the management server 11 determines the sewing machine 30 associated with the operation information obtaining device 100 that sends the operation information 200, and associates the information indicating the determined sewing machine 30 with the operation information 200. Then, the management server 11 executes a management processing for the operation information 200 (step S1302). The management processing includes, for example, assisting a start sewing and an end sewing of the pattern sewing based on the operation information 200. The management processing includes, for example, assisting in managing and responding to the poor condition that occurs during the pattern sewing based on the operation information 200. Afterwards, the operation information obtaining device 100 and the management server 11 perform the same processing.

Effects

As mentioned above, the operation information obtaining device 100 may determine the sewing pattern of the sewing machine 30 based on the detection information 124 detected by the detection device 50 and the pattern information 500 in the storage portion 120, and obtain the operation information 200 with the sewing pattern. Therefore, since the operation information obtaining device 100 may obtain the operation information 200 having the estimated sewing pattern, compared to the traditional operation information with only a rotation start and stop of the main shaft and the thread trimming, the operation information 200 of the sewing machine 30 may be effectively utilized in the present application.

The operation information obtaining device 100 may determine the sewing pattern with the sewing and the idle feeding of the sewing machine 30 based on the detection information 124 that may identify the state of the periodic action and non-action of the sewing needle 307 and the pattern information 500. Therefore, the operation information obtaining device 100 may improve the estimation accuracy of complex sewing patterns.

The operation information obtaining device 100 determines the poor condition of the sewing machine 30 based on the detection information 124 and the pattern information 500, and may obtain the operation information 200 that may identify the poor condition. Therefore, the operation information obtaining device 100 may obtain the poor condition in the sewing pattern of the sewing machine 30 through the operation information 200, thereby improving the convenience of the operation information 200.

The operation information obtaining device 100 may collect the detection information 124 of the sewing machine 30 that has executed the sewing pattern, and store the pattern information 500 associating the detection information 124 with the sewing pattern in the storage portion 120. Therefore, the operation information obtaining device 100 may store a plurality of different types of pattern information 500 in the storage portion 120, thereby improving the estimation accuracy of sewing patterns based on the detection information 124.

The operation information obtaining device 100 may be configured as a detection device 50 capable of detecting the detection information 124 of the sewing needle 307 of the sewing machine 30. Therefore, the operation information obtaining device 100 may be configured to be assembled on the sewing machine 30 or configured to be provided outside the sewing machine 30, thereby improving convenience.

The operation information obtaining method may determine the sewing pattern of the sewing machine 30 based on the detection information 124 detected by the detection device 50 and the pattern information 500 in the storage portion 120, and obtain the operation information 200 with the sewing pattern through a computer. Therefore, the operation information obtaining method may obtain the operation information 200 having the estimated sewing pattern, which may contribute to the effective utilization of the operation information 200 of the sewing machine 30 compared to the traditional operation information with only the rotation start and stop of the main shaft and thread trimming.

Other Embodiments

In the above implementation, a situation where the operation information obtaining device 100 is a structure having detection device 50 is described, but is not limited to this. For example, the operation information obtaining device 100 may also be configured as not having the detection device 50, and the detection information 124 may be obtained from the external detection device 50 provided on the device main body.

As the sewing machine 20 mentioned above, when an equipped detection device that detects a change in a structure of the sewing machine is equipped, it may also be configured to enable the equipped detection device to achieve a function of detection device 50. The operation information obtaining device 100 obtains the detection information 124 from the equipped detection device.

What is claimed is:

1. An operation information obtaining device, comprising:

a storage portion, configured to store pattern information associating detection information with a sewing pattern of a sewing machine, wherein the detection information is configured to identify an action of a sewing needle of the sewing machine, the sewing pattern corresponding to the detection information;

an estimation portion, configured to estimate the sewing pattern of the sewing machine based on the pattern information and the detection information; and an obtaining portion, configured to obtain operation information of the sewing machine including an estimated sewing pattern.

2. The operation information obtaining device of claim 1, wherein the estimation portion estimates the sewing pattern including both sewing and idle feeding of the sewing machine based on the detection information and the pattern information, wherein the detection information is further configured to identify states of a periodic action and a non-action of the sewing needle.

3. The operation information obtaining device of claim 2, wherein the estimation portion estimates a poor condition of a sewing of the sewing machine based on the detection information and the pattern information; and the obtaining portion obtains the operation information configured to identify the poor condition of the sewing of the sewing machine.

4. The operation information obtaining device of claim 3, further comprising:

a collection portion, configured to collect the detection information of the sewing machine that executes the sewing pattern, and store the pattern information in the storage portion, wherein the pattern information associates the detection information with the sewing pattern.

5. The operation information obtaining device of claim 4, further comprising:

a detection device, configured to detect the detection information.

6. A operation information obtaining method, comprising:

storing pattern information into a storage portion, the pattern information associating detection information with a sewing pattern of a sewing machine, wherein the detection information is configured to identify an action of a sewing needle of the sewing machine, the sewing pattern corresponding to the detection information;

determining the sewing pattern of the sewing machine based on the pattern information and the detection information; and obtaining operation information of the sewing machine including an estimated sewing pattern.

* * * * *